US007213620B2

(12) United States Patent
DeJonge

(10) Patent No.: US 7,213,620 B2
(45) Date of Patent: May 8, 2007

(54) COMBINATION CAP AND ADJUSTABLE SPOON FOR CONTAINER

(76) Inventor: Stuart W. DeJonge, 1770 The Hideout, Lake Ariel, PA (US) 18436

( * ) Notice: Subject to any disclaimer, the term of this patent is extended or adjusted under 35 U.S.C. 154(b) by 0 days.

(21) Appl. No.: 11/358,246

(22) Filed: Feb. 21, 2006

(65) Prior Publication Data

US 2006/0219316 A1 Oct. 5, 2006

Related U.S. Application Data

(63) Continuation-in-part of application No. 11/099,354, filed on Apr. 5, 2005.

(51) Int. Cl.
*B65B 1/04* (2006.01)

(52) U.S. Cl. ..... 141/22; 141/112; 141/322; 220/521

(58) Field of Classification Search ..... 141/22, 141/98, 110, 112, 322; 222/192; 215/228; 220/521
See application file for complete search history.

(56) References Cited

U.S. PATENT DOCUMENTS 1,706,815 A 3/1929 Phillipson
2,487,274 A 11/1949 Schaffer
3,312,366 A * 4/1967 Poris ..... 220/521
4,091,965 A 5/1978 Gebhard
4,192,360 A 3/1980 Rodriquez
4,373,640 A 2/1983 Resio
D268,813 S 5/1983 Horsley
5,165,558 A 11/1992 Cargile
5,678,450 A * 10/1997 Robbins et al. ..... 73/429
5,881,926 A 3/1999 Ross

* cited by examiner

*Primary Examiner*—Timothy L. Maust
(74) *Attorney, Agent, or Firm*—Kenneth P. Glynn

(57) ABSTRACT

A combination spoon-lid and a cap for a container includes a main container cap and a spoon-lid. The main container cap has a top and at least one sidewall and has a dispensing orifice located on the top. The cap also has a container attachment mechanism for removably attaching the cap to a container, and has a spoon-lid attachment mechanism on the top adapted to receive the spoon-lid and close the dispensing orifice. The spoon-lid has main structure with a first end with a scoop spoon section and has a second end in the form of a handle and has an adjustable gate for increasing and decreasing the volume of the scoop spoon section. The spoon-lid is removably connectable to the attachment mechanism of the main cap to cover and seal the dispensing orifice.

20 Claims, 4 Drawing Sheets

1 UNSCREW CAP

2 REMOVE FOIL

3 REPLACE CAP

4 SLIDE SPOON OUT

5 SELECT DOSAGE OR QUANTITY

6 FILL SPOON/CONSUME

7 REPLACE SPOON

COMBINATION CAP AND ADJUSTABLE SPOON FOR CONTAINER

REFERENCE TO RELATED PATENT APPLICATION

This application is a continuation in part of the U.S. patent application Ser. No. 11/099,354 filed on Apr. 5, 2005, by the same inventor as herein and entitled "Combination Spoon And Cap For Container".

BACKGROUND OF THE INVENTION

1. Field of the Invention

The present invention relates to container caps and to metered dispensed material, such as powder, granular, acicular, and other shaped material that should be used in predetermined amounts. Specifically, the present invention is a cap with a combination spoon-lid wherein the spoon-lid is removable from the container to open a dispensing orifice and, when removed, acts as a spoon for metered dispensing of the material in the container, for predetermined amount usage. The spoon-lid includes a main structure with a handle and a scoop, and an adjustable gate means at least partially inside the scoop that is moveable so as to increase or decrease the volume of the scoop. Thus, for example, a user could set the spoon for a half dose, a full dose or a double dose, or a ¼ tablespoon, a ½ tablespoon, a ¾ tablespoon or a full tablespoon. This invention has use in the fields of medicine, nutrition and vitamins, supplements, pest poisons, seasonings and many other applications.

2. Information Disclosure Statement

The following prior art is representative of the state of the art in the field of caps and closures with measuring features:

U.S. Pat. No. Des. 268,813 to Ronald L. Horsley describes the ornamental design for a combined container and cap with attached spoon, substantially as shown and described.

U.S. Pat. No. 1,706,815 to Ferdinand Phillipson describes in combination, a sheet metal bottle closure, and a measuring receptacle attached integrally at one edge directly to said bottle closure and adapted to lie outside of and along the neck of the bottle and between the mouth and the body of the bottle.

U.S. Pat. No. 2,487,274 to Max Schaffer describes the combination with a medicine bottle having an eccentric neck, a closure cap detachably engaged with the neck, a metal bar secured to the closure cap and provided on one end with a helical hinge coil, a spoon having a helical hinge coil on one end thereof slidably and detachably engaged with the hinge coil of the bar, and a ring slidable on the bottle for restraining the spoon against the side of the bottle.

U.S. Pat. No. 4,091,965 to Albert W. Gebhard describes a container for flowable materials such as baby food and the like that has a circular shaped enclosing cap with a post opening into the interior of the container. A cover having an elongated hollow extension terminating in a feeder or dispenser portion releasably engages the circular cap so that the hollow extension can be routably aligned with the cap port thereby allowing transfer of flowable materials from the container into the feeder portion by gravity, flexure of the container of both. The cover is rotatable on the circular cap so as to control the amount of opening alignment with the cap port between a fully open and fully sealing closure position. The cover and cap can include cooperating stops for facilitating alignment and closure. An O-ring in surrounding relation to the cap port provides additional sealing.

U.S. Pat. No. 4,192,360 to Oswaldo J. Rodriquez describes a measuring device that has a cooperative plastic measuring liquid dropper dispensing a precise volume of liquid directly into an integral plastic spoon bowl. The spoon bowl is integrally foldably hinged to the dispensing tip of the medicine dropper by an integral plastic hinge. An integral plastic snap lock projection disposed on the outer surface of the dropper retains the spoon bowl in a compact storage position in a bottle of liquid.

U.S. Pat. No. 4,373,640 to George F. Resio decribes a bottle top of generally cup type configuration that is removably affixed to a medicine bottle at the open top thereof for selectively opening and closing such top. A plastic spoon has an elongated stem integrally formed with the bottle top and extends therefrom. Thus, a consumer of medicine from the bottle having a contagious illness prevents the spread of his illness by utilizing the spoon to convey medicine from the bottle to his mouth.

U.S. Pat. No. 5,165,558 to David W. Cargile describes a blow molded container having a break-way measuring and dispensing cup. In the disclosed embodiments, the cup is formed during molding from a web extending along a parting line of the blow-molded container body. The web has a weakened region which detachably connects the cup to the container. The cup can be reattached either on the container or its cap in a non-use storage position.

U.S. Pat. No. 5,881,926 to Malcolm Ross describes a pharmaceutical formulation in semisolid form useful for a systemic treatment of an illness that is disclosed, as well as a device for containing and measuring a unit dose of the formulation comprising a squeezable container having a cap with a spoon attached hereto and closure for resealing the squeezable container after use. A child proof closure useful for the device is also disclosed.

Notwithstanding the prior art, the present invention is neither taught nor rendered obvious thereby.

SUMMARY OF THE INVENTION

The present invention relates to a combination spoon-lid and a cap for a container. The invention includes a main container cap and a spoon-lid.

The main container cap has a top and at least one sidewall and has a dispensing orifice located on the top. The cap also has a container attachment means for removably attaching the cap to a container, and has a spoon-lid attachment means on the top adapted to receive the spoon-lid and close the dispensing orifice.

The spoon-lid has main structure with a first end with a dished (scoop) spoon section and has a second end in the form of a handle. The spoon lid has an adjustable gate means that is moveable to increase or decrease the volume of the scoop spoon section. This adjustable gate means could have any movement mechanism and movement direction, e.g., front to back or left to right, but an ergonomically advantageous arrangement is to have the gate slide front to back and vice versa for ease and comfort of the user. The gate may be a single structure with a slider handle and with a gate wall inside the scoop section. The slider handle could be ratcheted to keep its position, or not and the slider handle could contour all or part of the main structure handle and be located atop or under it. On top is easier, as under the main handle would require a connection through or around the main structure from the slider handle to the gate wall. For example, the main handle could be curved or flat and the slider handle would be concomitantly curved or flat and snapped into a slide on the main handle.

The spoon-lid adapted to removably connect to the attachment means of the main cap to cover and seal dispensing orifice. In some preferred embodiments of the present invention combination spoon-lid and a cap for a container, the spoon-lid attachment means is a recess in the cap top adapted to receive and hold the spoon-lid over the dispensing orifice.

In some preferred embodiments of the present invention combination spoon-lid and cap, the spoon-lid has a peripheral edge in a single plane and the spoon-lid attachment means is a slide track for receiving the peripheral edge of the spoon-lid.

In some preferred embodiments of the present invention combination spoon-lid and a cap for a container, at least a portion of the handle is flat and the cap has a receiving slot adapted to tightly receive and hold at least a portion of the handle.

In some preferred embodiments of the present invention combination spoon-lid and a cap for a container, the cap has a circular top view shape with a center and the dispensing orifice is off-center.

In some preferred embodiments of the present invention combination spoon-lid and cap, the container attachment means is selected from the group consisting of screw threading, ratcheting and snap-on attachment means.

In some preferred embodiments, the scoop spoon section is box-like, with a rectangular top view footprint, and the gate wall is flat. Thus, the scoop has a predetermined width, length and height, and the gate wall has about the same height and width to fit into the scoop and slide back and forth therein to increase or decrease the scoop volume. Although the scoop may never be used to scoop any powder or other product, e.g., when the product is poured into the scoop, the word "scoop" is used to connote any functional shape that could be used to scoop a powder and that could functionally include an adjustable gate means.

The present invention is also directed to the combination of a spoon-lid, a main cap and a container. It includes: a) a container; b) a main container cap having a top and at least one sidewall, the cap having a dispensing orifice located on the top, having container attachment means for attaching the cap to a container, and having spoon-lid attachment means on the top adapted to receive the spoon-lid, the cap being attached to the container; and, c) the spoon-lid having a main structure with a first end with a scoop spoon section and having a second end in the form of a handle, and an adjustable gate means for setting the volume of the scoop section. The spoon-lid is adapted to removable connect to the attachment means to cover and seal the dispensing orifice.

These embodiments may have any or all of the various possible features described above for the spoon-lid and main cap. The container itself may have any shape and the attachment, opening and closing of the cap may involve any functional arrangement available.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
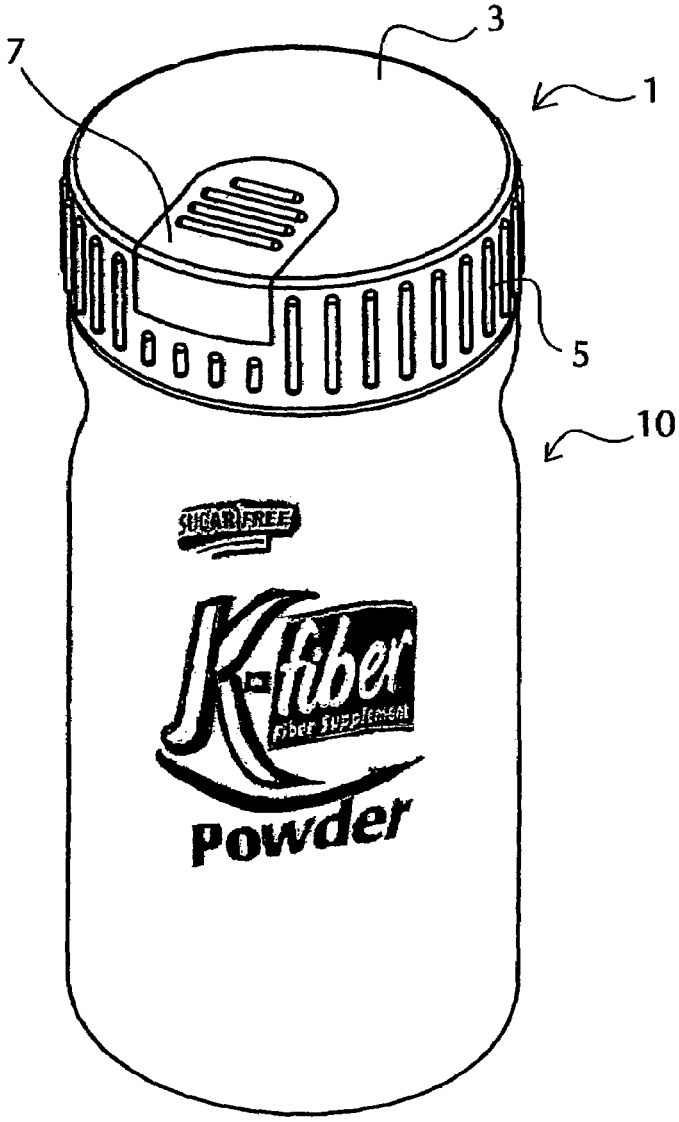
FIG. 1 illustrates an oblique front view of a present invention container, spoon-lid and main cap.

FIG. 1 illustrates an oblique front view of a present invention main cap 1, spoon-lid 7 and container 10. Main cap 1 has a top 3, sidewall 5 and internal threads, Not revealed in this Figure. Main cap 1 is screwed on to threaded container 10, but could be snapped on, ratcheted or otherwise attached in a removable or non-removable mode. Spoon-lid 7 is slid into cap 1 for closure of cap 1 and this is illustrated in more detail in the following Figures.

Figure 2:
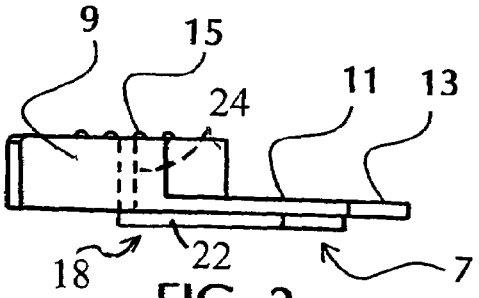
FIG. 2 shows a side view.
Figure 3:
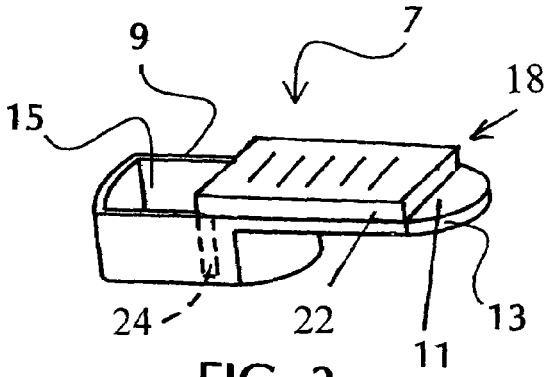
FIG. 3 shows an oblique side view of one preferred spoon-lid of the present invention.
Figure 4:
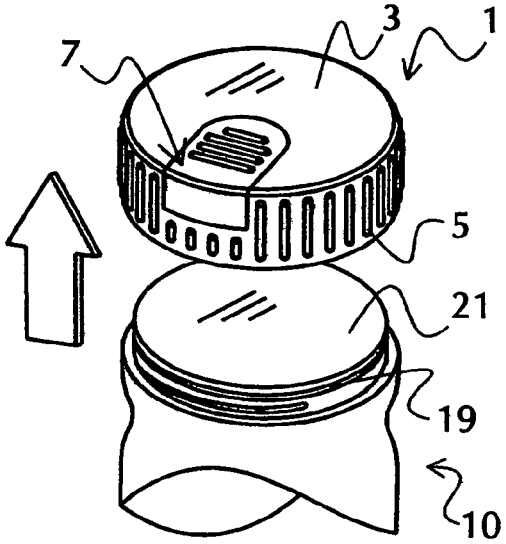
FIGS. 4, 5, 6, 7, 8*a*, 8*b*, 8*c*, 8*d*, 8*e*, 8*f*, 8*g*, 9 and 10 show the present invention device of FIG. 1 in various stages of use.
Figure 5:
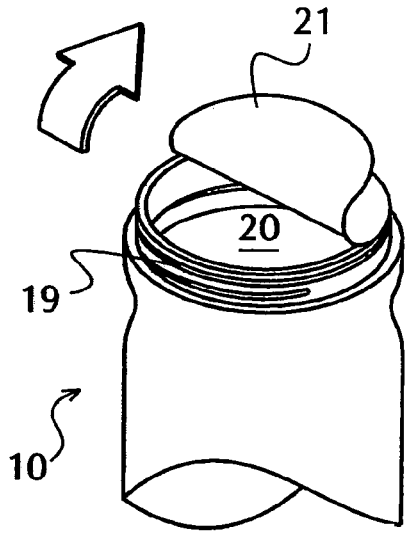
Figure 6:
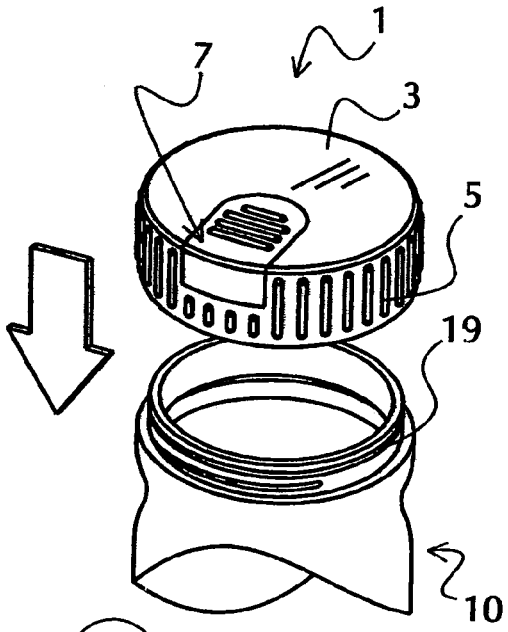
Figure 7:
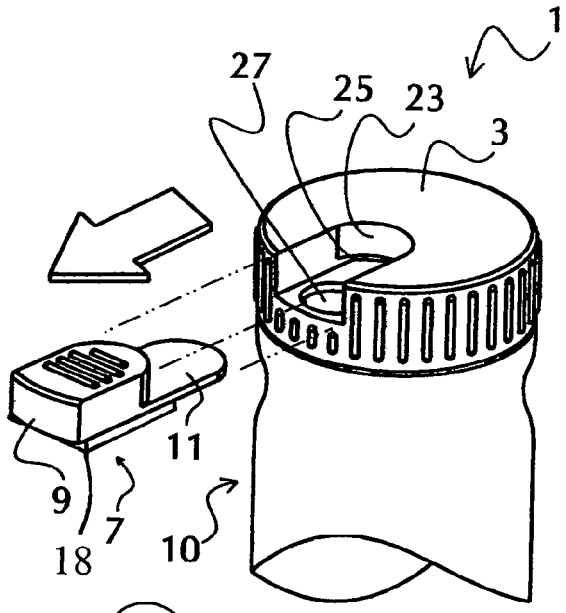

FIG. 2 shows a side view and FIG. 3 shows an oblique side view of the preferred spoon-lid 7 of FIG. 1. Spoon-lid 7 has a hollow scoop area 15 established by sidewall 9 to create the bowl or dish end of a spoon, and it has a flat handle area 11, an insertable end 13. The insertable end 13 is used to secure the spoon-lid 7 to a container for insertion into the container to simultaneously close its dispensing orifice and conveniently store the spoon-lid, as shown and described below.

There is an adjustable gate means 18 with a slide handle portion 22 and with a wall 24 that is located within scoop area 15. Movements of slide handle portion 22 effect movements of wall 24 to adjust the volumetric capacity of scoop area 15. The device may or may not include volume indication arrangements, e.g. indicia on either the main structure or the gate means and a set marking on the other of those. Thus, in some embodiments, indicia may be embossed, printed or otherwise set on the top or the side of the main structure and on the slider handle portion of the adjustable gate means to show settings for desired capacities. For example, if a present invention device is intended for sugar or spice, measurement indicia may be optional and the user can "adjust to suit", whereas, if a present invention device is used for powdered medicine, especially prescription medicine, dosage measurement markings may be essential.

FIGS. 4, 5, 6, 7, 8*a*, 8*b*, 8*c*, 8*d*, 8*e*, 8*f*, 8*g*, 9 and 10 show present invention devices in various stages of use. These Figures are described here collectively and not all elements or reference numerals are intended to be in every Figure.

The container 10 has a threaded neck 19, and a freshness and tamper evident seal 21, with granular fiber supplement 20 contained therein. Any flowable material could be stored therein in place of the fiber supplement 20, but the invention is excellent for dispensing particle size solids, such as fiber, powdered vitamin and mineral supplements, plant food, fish food, powdered medications, spices and other seasonings, etc.

Main cap 1 has a top 3, sidewall 5, spoon-lid receiving cut-out 23, recess 25 and dispensing orifice 27. Cut-out 23 is the receiving part of the cap 1 so that spoon-lid 7 is placed and slid into it so that spoon-lid tip 13 enters recess 25. There is a ridge in the recess 25 to bias slider handle portion 22 toward the outer edge at the rim so that when spoon-lid 7 is inserted, slider handle portion 22 is positioned over the orifice 27 to close it. (Instead of a slider handle portion that sits atop the main structure, other arrangements could be used without exceeding the scope of the present invention. For example, the slider handle portion could be set into a recess on the handle of the main structure, and this type of arrangement is discussed further in conjunction with FIG. 8*a* through FIG. 8*g* below.)

Step 1 (FIG. 4) involves removal of main cap 1 to expose seal 21. Next, in step 2 (FIG. 5), seal 21 is removed in a conventional fashion, e.g. peeled off. In step 3 (FIG. 6), the cap 1 is replaced onto the container 10, in this case, by being screwed on. In step 4 (FIG. 7), the spoon-lid 7 is slid out from cap 1.

In step 5 (FIGS. 8*a* through 8*g*), the adjustable gate means is set to the desired volume, and in step 6 (FIG. 9), the spoon-lid 7 is inverted to function as a spoon, material 30 is poured out of dispensing orifice 27 into hollow scoop area 15 to fill it and to hence create a specified amount for consumption or other use. Thereafter, in step 7 (FIG. 10), spoon-lid 7 is replaced to the cap 1 and covers the dispensing orifice 27 to close it. Since seal 21 has been permanently removed only steps 4, 5 and 6 are followed for future use.

In FIGS. 8*a* through 8*g*, a variation in the present invention device described in the previous Figures is shown. However, the functionality is the same and the description of the function of spoon-lid 70 in these Figures may be applied to use of spoon-lid 7 above, except that volumes are estimated instead of set by indicia. Thus, the differences are indicia versus no indicia and recessed versus raised gate handle portions. However, in both embodiments, the slider handle portion is moved back and forth to increase or decrease the volume of the scoop.

Figure 8A:
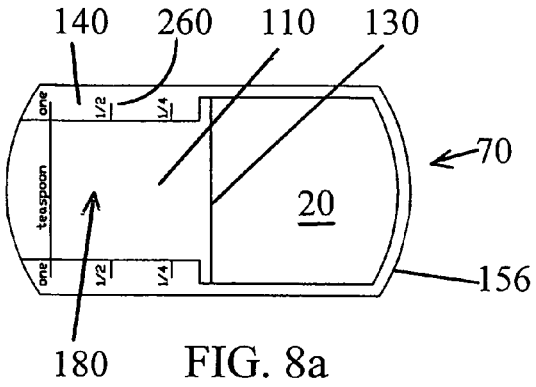

In FIG. 8*a*, there is shown spoon-lid 70 with scoop 20 and adjustable gate means 180, which includes a front 156, sidewalls, a back, and handle 140, and has the general shape of a spoon. There are indicia, such as ½ teaspoon marking 260, and a recess and tracks for adjustable gate means 180. Adjustable gate means 180 includes a slider handle portion 110 with a set mark, as shown, and a wall 130.

Figure 8B:
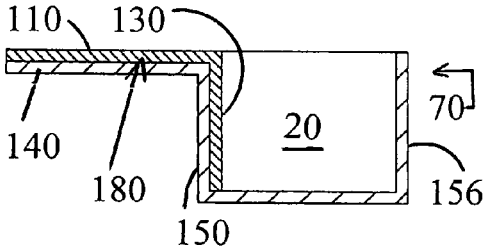
Figure 8C:
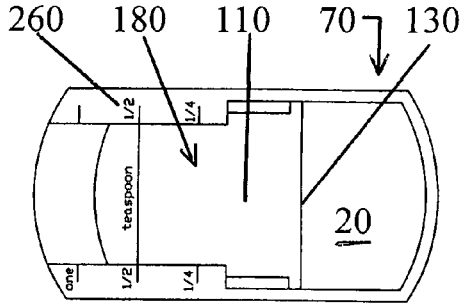
Figure 8E:
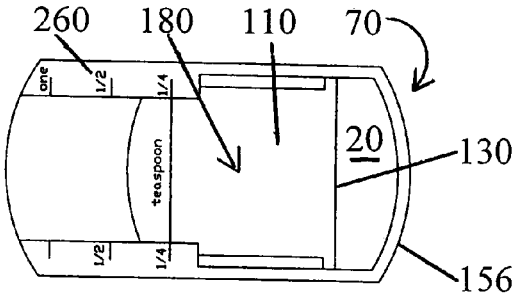
Figure 8D:
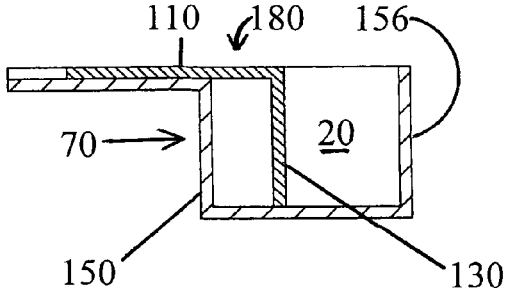
Figure 8F:
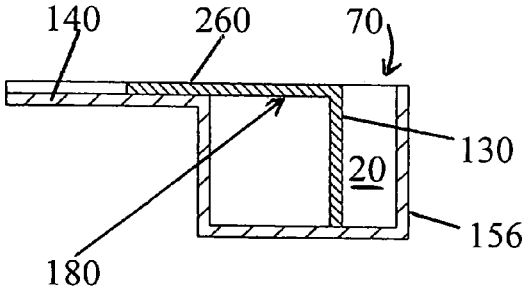
Figure 8G:
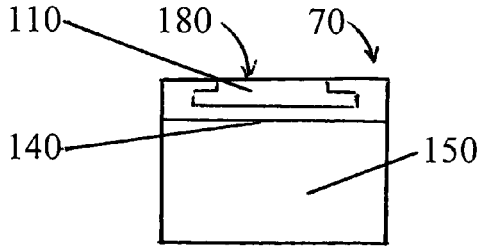
Figure 9:
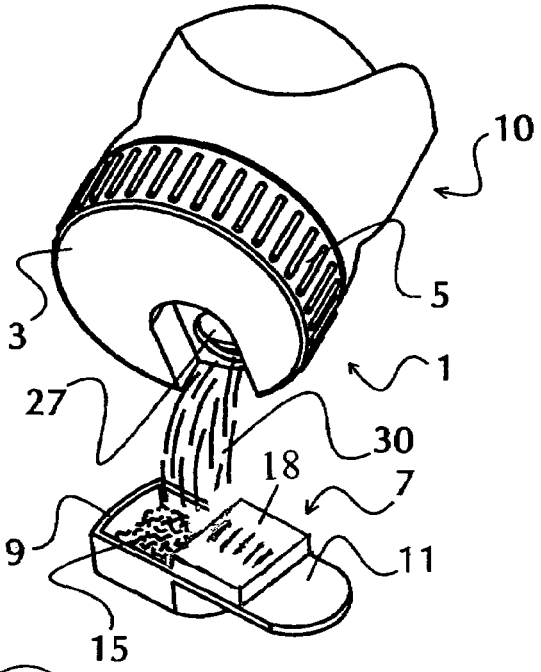
Figure 10:
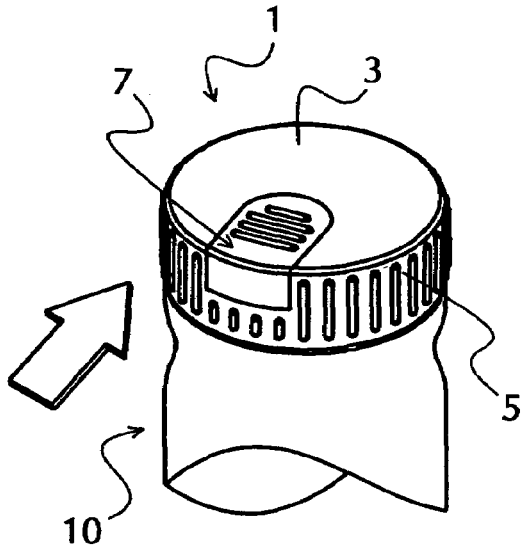

FIG. 8*b* shows spoon-lid 70 in its fully open position with gate means 180 slid back to maximize scoop 20 volume for a full teaspoon. In FIG. 8*c*, top view, and FIG. 8*d*, side view, the gate means 180 is set at ½ teaspoon; in FIG. 8E, top view and FIG. 8*f*, side view, it is set at ¼ teaspoon. FIG. 8 *g* shows a back end view of the device with scoop back 150 facing the viewer, to illustrate the recess and the tracks in the main structure for slidably supporting the adjustable gate means 180.

Figure 11:
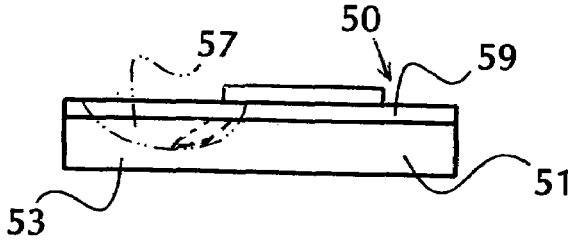
FIG. 11 illustrates another preferred embodiment of a present invention spoon-lid and FIG. 12 shows the FIG. 11 device inserted into a container cap for closure thereof.
Figure 12:
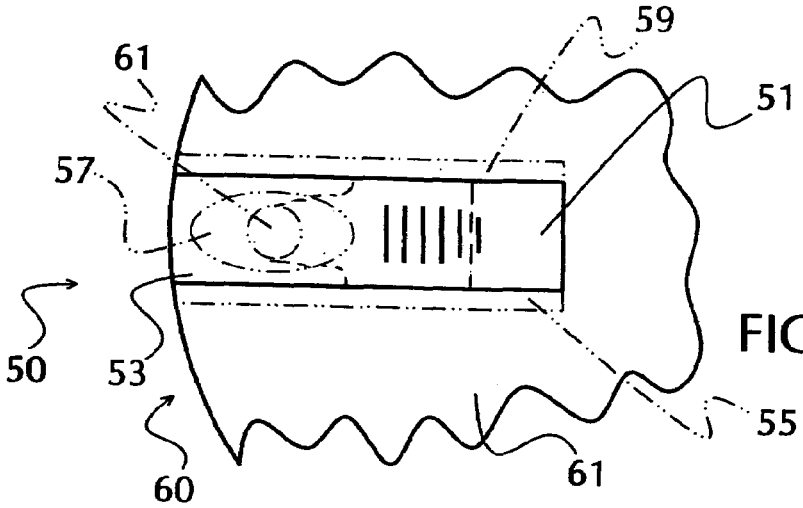

FIG. 11 illustrates another preferred embodiment of a present invention spoon-lid 50 and FIG. 12 shows it inserted into container cap 60 for closure thereof. Spoon-lid 50 has a handle end 51 and a spoon end 53 with dished out area and includes an adjustable gate means 57 that has a curved front instead of a flat wall to conform to the shape of the dished out area. Spoon-lid 50 has side rails 55 and 59 to slide into corresponding slots on cap 60 for covering and closure of its dispensing orifice 63 on top 61.

Obviously, numerous modifications and variations of the present invention are possible in light of the above teachings. It is therefore understood that within the scope of the appended claims, the invention may be practiced otherwise than as specifically described herein.

What is claimed is:

1. A combination spoon-lid and a cap for a container, which comprises:

a) a main container cap having a top and at least one sidewall, said cap having a dispensing orifice located on said top, having container attachment means for removably attaching said cap to a container, and having spoon-lid attachment means on said top adapted to receive said spoon-lid, wherein said spoon-lid attachment means is a slide track for receiving a peripheral edge of said spoon-lid; and, b) said spoon-lid having a first end with a dished spoon section and having a second end in the form of a handle and having said peripheral edge in a single plane, said spoon-lid adapted to removably connect to said attachment means to cover and seal dispensing orifice, said spoon-lid further having an adjustable gate means that is manually moveable within said scoop spoon to increase and decrease said scoop spoon section's volume.

2. The combination spoon-lid and a cap for a container of claim 1 wherein said spoon-lid attachment means is a recess in said cap top adapted to receive and hold said spoon-lid over said dispensing orifice.

3. The combination spoon-lid and a cap for a container of claim 1 wherein at least a portion of said handle is flat and said cap has a receiving slot adapted to tightly receive and hold at least a portion of said handle.

4. The combination spoon-lid and a cap for a container of claim 1 wherein said cap has a circular top view shape with a center and said dispensing orifice is off-center.

5. The combination spoon-lid and a cap for a container of claim 2 wherein said cap has a circular top view shape with a center and said dispensing orifice is off-center.

6. The combination spoon-lid and a cap for a container of claim 3 wherein said cap has a circular top view shape with a center and said dispensing orifice is off-center.

7. The combination spoon-lid and a cap for a container of claim 1 wherein said adjustable gate means includes a moveable handle and wall.

8. The combination spoon-lid and a cap for a container of claim 1 wherein said scoop spoon section has a rectangular top view footprint and has a predetermined width, length and height and said wall is a flat vertical wall that is positioned inside said scoop spoon section with a width and a height approximating said scoop spoon section width and height.

9. The combination spoon-lid and a cap for a container of claim 1 wherein said container attachment means is selected from the group consisting of screw threading, ratcheting and snap-on attachment means.

10. The combination spoon-lid and a cap for a container of claim 9 wherein said container attachment means is screw threading attachment means.

11. A combination spoon-lid, cap and container, which comprises:

a) a container;

b) a main container cap having a top and at least one sidewall, said cap having a dispensing orifice located on said top, having container attachment means for attaching said cap to a container, and having spoon-lid attachment means on said top adapted to receive said spoon-lid, wherein and said spoon-lid attachment means is a slide track for receiving a peripheral edge of said spoon-lid, said cap being attached to said container; and, c) said spoon-lid having a first end with a dished spoon section and having a second end in the form of a handle, and having said peripheral edge in a single plane, said spoon-lid adapted to removable connect to said attachment means to cover and seal said dispensing orifice, said spoon-lid further having an adjustable gate means that is manually moveable within said scoop spoon to increase and decrease said scoop spoon section's volume.

12. The combination spoon-lid, cap and container of claim 11 wherein said spoon-lid attachment means is a recess in said cap top adapted to receive and hold said spoon-lid over said dispensing orifice.

13. The combination spoon-lid, cap and container of claim 11 wherein at least a portion of said handle is flat and said cap has a receiving slot adapted to tightly receive and hold at least a portion of said handle.

14. The combination spoon-lid, cap and container of claim 11 wherein said cap has a circular top view shape with a center and said dispensing orifice is off-center.

15. The combination spoon-lid, cap and container of claim 12 wherein said cap has a circular top view shape with a center and said dispensing orifice is off-center.

16. The combination spoon-lid, cap and container of claim 13 wherein said cap has a circular top view shape with a center and said dispensing orifice is off-center.

17. The combination spoon-lid and a cap for a container of claim 11 wherein said adjustable gate means includes a moveable handle and wall.

18. The combination spoon-lid and a cap for a container of claim 11 wherein said scoop spoon section has a rectangular top view footprint and has a predetermined width, length and height and said wall is a flat vertical wall that is positioned inside said scoop spoon section with a width and a height approximating said scoop spoon section width and height.

19. The combination spoon-lid, cap and container of claim 11 wherein said container attachment means is selected from the group consisting of screw threading, ratcheting and snap-on attachment means.

20. The combination spoon-lid, cap and container of claim 19 wherein said container attachment means is screw threading attachment means.

* * * * *